US007965023B1

(12) United States Patent
Liang

(10) Patent No.: US 7,965,023 B1
(45) Date of Patent: Jun. 21, 2011

(54) LED LAMP

(75) Inventor: Jim-Hung Liang, Taipei (TW)

(73) Assignee: Skynet Electronic Co., Ltd., Taipei (TW)

( * ) Notice: Subject to any disclaimer, the term of this patent is extended or adjusted under 35 U.S.C. 154(b) by 0 days.

(21) Appl. No.: 12/659,682

(22) Filed: Mar. 17, 2010

(51) Int. Cl.
*H01J 1/02* (2006.01)

(52) U.S. Cl. ..... 313/45; 313/46

(58) Field of Classification Search ..... 313/45–47, 313/318.01, 318.09
See application file for complete search history.

(56) References Cited

U.S. PATENT DOCUMENTS 6,583,542 B2 * 6/2003 Nagano et al. ..... 313/318.01
6,982,518 B2 * 1/2006 Chou et al. ..... 313/46
7,892,031 B1 * 2/2011 Mostoller et al. ..... 439/611
* cited by examiner

*Primary Examiner* — Vip Patel
(74) *Attorney, Agent, or Firm* — Bacon & Thomas, PLLC

(57) ABSTRACT

The present invention is to provide an LED lamp, which comprises a heat dissipation housing formed with a receiving hole axially passed therethrough, an insulation housing, an electrode cap connected to the insulation housing, a power PCB, and an installation base plate having a first side installed with at least one LED. A manufacturer only needs to firstly insert the insulation housing along with the electrode cap into the receiving hole for allowing the electrode cap to be extended out of a lower end of the heat dissipation housing, then insert the power PCB into the insulation housing and electrically connect the power PCB to the electrode cap, and finally position a second side of the installation base plate on the upper end of the heat dissipation housing and electrically connect the installation base plate to the power PCB, so as to rapidly complete the installation of the LED lamp.

7 Claims, 3 Drawing Sheets

LED LAMP

FIELD OF THE INVENTION

The present invention relates to an LED (light emitting diode) lamp, more particularly to an LED lamp having an electrode cap connected to an insulation housing thereof, so that a manufacturer only needs to firstly insert the insulation housing along with the electrode cap into a heat dissipation housing of the LED lamp and then rapidly completes the installation of the LED lamp.

BACKGROUND OF THE INVENTION

In the past, people use incandescent lamps for night or indoor illumination because the incandescent lamps can provide some advantages including simple installation. However, since the incandescent lamps also have some disadvantages including high power consumption, short lamp life (average life of only about 1,000 hours) etc., more and more users change to use energy-saving fluorescent lamps about ten years ago based on demands of environmental protection and energy saving. The so-called "fluorescent lamp" is an integral illumination apparatus constructed by a fluorescent bulb and a ballast, with an average life up to 6,000 hours. The size of the fluorescent lamp is similar to that of the incandescent lamp, wherein a holder interface (i.e. an electrode cap or head) of the fluorescent lamp is also the same as that of the incandescent lamp, so that the fluorescent lamp can be directly used to replace the incandescent lamp. In addition, the luminous efficiency of the fluorescent lamp is considerably greater than that of the incandescent lamp, and the power consumption of the fluorescent lamp is considerably less than that of the incandescent lamp under identical illumination conditions. Thus, generally, the fluorescent lamp is also called an energy-saving lamp.

In addition to the foregoing incandescent lamp and fluorescent lamp, with the development of light emitting diodes (LEDs) technologies, many lamp manufacturers start to develop and manufacture various different types of illumination apparatuses using LEDs as the main light sources. Because the LED lamps can provide some advantages including energy saving, long lamp life (about 40,000 hours), and toxic substances (such as mercury, Hg) free, while the light spectrum generated by the light source of the LED lamps almost doesn't include ultraviolet or infrared, wherein the light emitted by the LEDs almost has no problems of waste heat or irradiation. Besides, the cost of the LEDs is lowered day by day, so that more and more users pay attention to various possible applications of the LED lamps.

Recently, Sharp Corporation in Japan developed a new type of LED lamps which has an inner space for receiving a power printed circuit board (PCB) and being filled with a filler material used to increase the efficiency of thermal conduction and cooling of the power PCB. However, because the weight of the filler material is heavy and the cost of the filler material is relatively high, the type of LED lamp can not be widely used in the market of the LED lamps. Then, Toshiba Corporation developed another series of LED lamps called E-CORE to improve the foregoing disadvantages for the purpose of lowering the cost and sell price thereof to increase the market share. However, there are still some problems existing in the installation of the type of LED lamps in the production line. The structure of the type of LED lamps will be described below with reference to FIG. 1.

An LED lamp as shown in FIG. 1 comprises a heat dissipation housing 10, an electrode cap 11, an insulation resin housing 12, a power printed circuit board (PCB) 13, a light emitting module 14 and a lamp shade 15, wherein the heat dissipation housing 10 is made of aluminum alloy and generally formed by metal casting to integrate into one piece. The heat dissipation housing 10 is extended outward to form a plurality of cooling fins 100, while a lower side of the heat dissipation housing 10 is formed with a receiving hole (not shown) therein for receiving the insulation resin housing 12. In addition, an upper side of the heat dissipation housing 10 is formed with a first wire hole 101, while an upper side of the insulation resin housing 12 is formed with a second wire hole 120 and a thread hole 121, wherein the insulation resin housing 12 is screw-connected into the receiving hole of the heat dissipation housing 10 by a screw 16. The power PCB 13 is disposed in the insulation resin housing 12 to prevent wires or electronic components on the power PCB 13 from directly contacting the heat dissipation housing 10 according to the good insulation property of the insulation resin housing 12, so as to protect the power PCB 13 from possible short-circuit problem. Furthermore, the light emitting module 14 has an installation base plate 141 and a plurality of LEDs 142, wherein one side of the installation base plate 141 is provided with conductive circuits (unlabeled) which are connected to and installed with the LEDs 142, respectively. The installation base plate 141 is also formed with a third wire hole 143, wherein two wires 130 of the power PCB 13 can pass through the second, first and third wire holes 120, 101, 143 in turn to be electrically connected to the conductive circuits on the installation base plate 141 of the light emitting module 14. Moreover, the other two wires 131 of the power PCB 13 can be electrically connected to the electrode cap 11 which is screw-connected to a lower end of the insulation resin housing 12. The light emitting module 14 can obtain an external power through the power PCB 13 and the electrode cap 11 and then supply the power to the LEDs 142, so that the LEDs can emit the light.

Besides, as shown in FIG. 1, the other side of the installation base plate 141 is installed on the upper side of the heat dissipation housing 10, so that waste heat generated by the LEDs 142 can be transferred to the heat dissipation housing 10 through the other side of the installation base plate 141 and dissipated to the ambient atmosphere through the heat dissipation housing 10. As a result, the operational temperature of the LEDs 142 can be efficiently lowered down, so that the LEDs can emit ideal color light. In addition, the shape of the lamp shade 15 is approximately a semi-sphere shape, and the lamp shade 15 is covered on the heat dissipation housing 10. An opening edge (unlabeled) of the lamp shade 15 is attached to an edge of the upper side of the heat dissipation housing 10 by adhesive. The light emitted by the LEDs 142 can pass through the lamp shade 15 to illuminate an external environment of the LED lamp.

Generally, when a lamp manufacturer installs the foregoing LED lamp in a production line, the insulation resin housing 12 is firstly installed into the heat dissipation housing 10 from the lower side of the heat dissipation housing 10. Then, the screw 16 is screw-connected into the thread hole 121 of the insulation resin housing 12, in order to position the insulation resin housing 12 into the heat dissipation housing 10. After this, the power PCB 13 is installed and positioned in the insulation resin housing 12, and then electrically connected to the electrode cap 11 through the wires 131. However, an operator must manually install the insulation resin housing 12 into the heat dissipation housing 10 and then screw-connect the insulation resin housing 12 to a predetermined position of the heat dissipation housing 10 through the screw 16 in turn. Thus, the manual installation needs too much man power and substantially increase the operational time of the production line, so as to cause negative effect to the production efficiency of the lamp manufacturer and increase the error installation risk of the operator. For example, the insulation resin housing 12 or the electrode cap 11 may not be positioned to the predetermined positions of the heat dissipation housing 10, so as to lower the product yield of the LED lamp. Moreover, when the operator installs the insulation resin housing 12 into the heat dissipation housing 10, an offset of the positioning precision between the insulation resin housing 12 and the heat dissipation housing 10 may be easily occurred to cause too low product yield of the LED lamp.

As a result, it is an important issue for the present invention to think how to improve the structure of the traditional LED lamp, in order to simplify the component processing and the installation procedure thereof for the purpose of substantially enhancing the production efficiency and the product yield of the LED lamp.

It is therefore tried by the inventor to develop an LED lamp to simplify the component processing and the installation procedure thereof, so as to further enhance the production efficiency and the product yield of the LED lamp.

BRIEF SUMMARY OF THE INVENTION

An object of the present invention is to provide an LED (light emitting diode) lamp, which comprises a heat dissipation housing, an insulation housing, an electrode cap, a power printed circuit board (PCB), at least one LED, an installation base plate and a lamp shade, wherein the heat dissipation housing is formed with a receiving hole axially passed therethrough, and a position of an upper end of the heat dissipation housing adjacent to the receiving hole is formed with an engaged indentation. The insulation housing is made of insulation material, and the profile of the insulation housing can be installed into the receiving hole. An upper end of an outer periphery of the insulation housing is radially extended to form a projection which can be inserted and engaged into the engaged indentation in a case that the insulation housing is installed in the receiving hole. Furthermore, each of two opposite positions of an inner periphery of the insulation housing is axially formed with a positioning portion, respectively. The electrode cap comprises a first electrode and a second electrode, wherein an opening edge of the electrode cap is connected to a lower end of the insulation housing. Thus, in a case that the insulation housing is installed in the receiving hole and the projection is engaged with the engaged indentation, the electrode cap is extended out of a lower end of the heat dissipation housing, so that the first and second electrodes can be used to receive an external power. The power PCB is received in the insulation housing, wherein two opposite side edges of the power PCB are clamped by the two positioning portions, respectively, so that the power PCB can be stably positioned in the insulation housing. The power PCB is electrically connected to the first and second electrodes, respectively, for receiving the external power supplied through the first and second electrodes. The installation base plate has a first side (upper side) provided with conductive circuits for installing the LED and being electrically connected to the power PCB, and a second side (lower side) connected to the upper end of the heat dissipation housing. The lamp shade is covered on the first side of the installation base plate, and an opening edge of the lamp shade is connected to an edge of the upper end of the heat dissipation housing. Therefore, when a manufacturer installs the LED lamp of the present invention, it only needs to firstly insert the insulation housing with the electrode cap connected to the lower end thereof into the receiving hole for allowing the electrode cap to be extended out of the lower end of the heat dissipation housing and allowing the projection to be engaged with the engaged indentation, secondly insert the power PCB into the insulation housing for electrically connecting the power PCB to the first and second electrodes and electrically connecting the power PCB to the installation base plate, thirdly position the installation base plate on the upper end of the heat dissipation housing, and finally cover the lamp shade on the upper end of the heat dissipation housing to finish the LED lamp. According to the present invention, the manufacturer can rapidly complete the installation of the LED lamp. As a result, it not only can prevent the error installation of operators and the imprecise positioning problem of all components, but also can decrease the operational time of installing one LED lamp by the operators, so as to substantially enhance the product yield and the production efficiency.

BRIEF DESCRIPTION OF THE SEVERAL VIEWS OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE INVENTION

Figure 1:
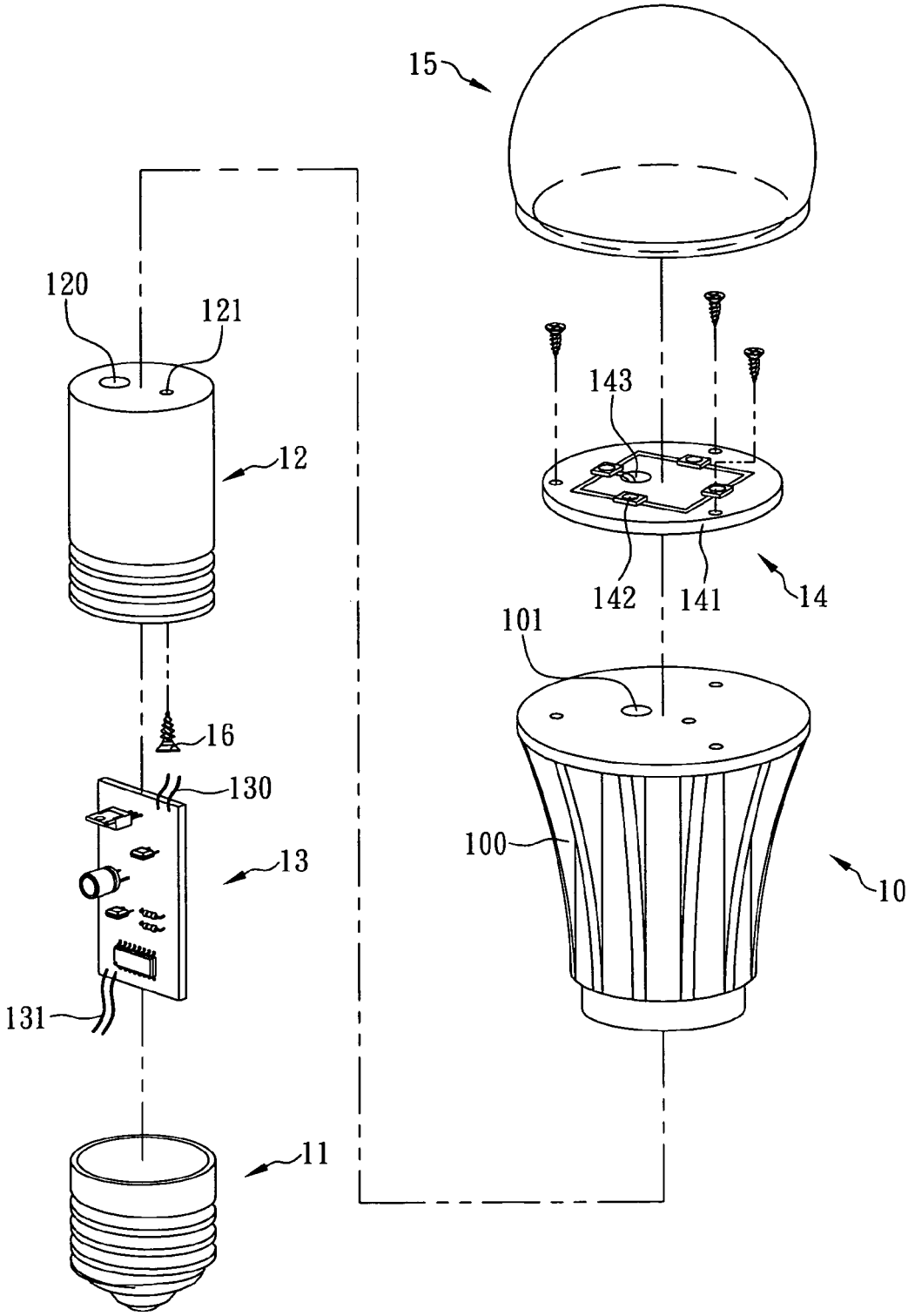
FIG. 1 (Prior Art)
FIG. 1 is an exploded perspective view of a traditional LED lamp.
Figure 2:
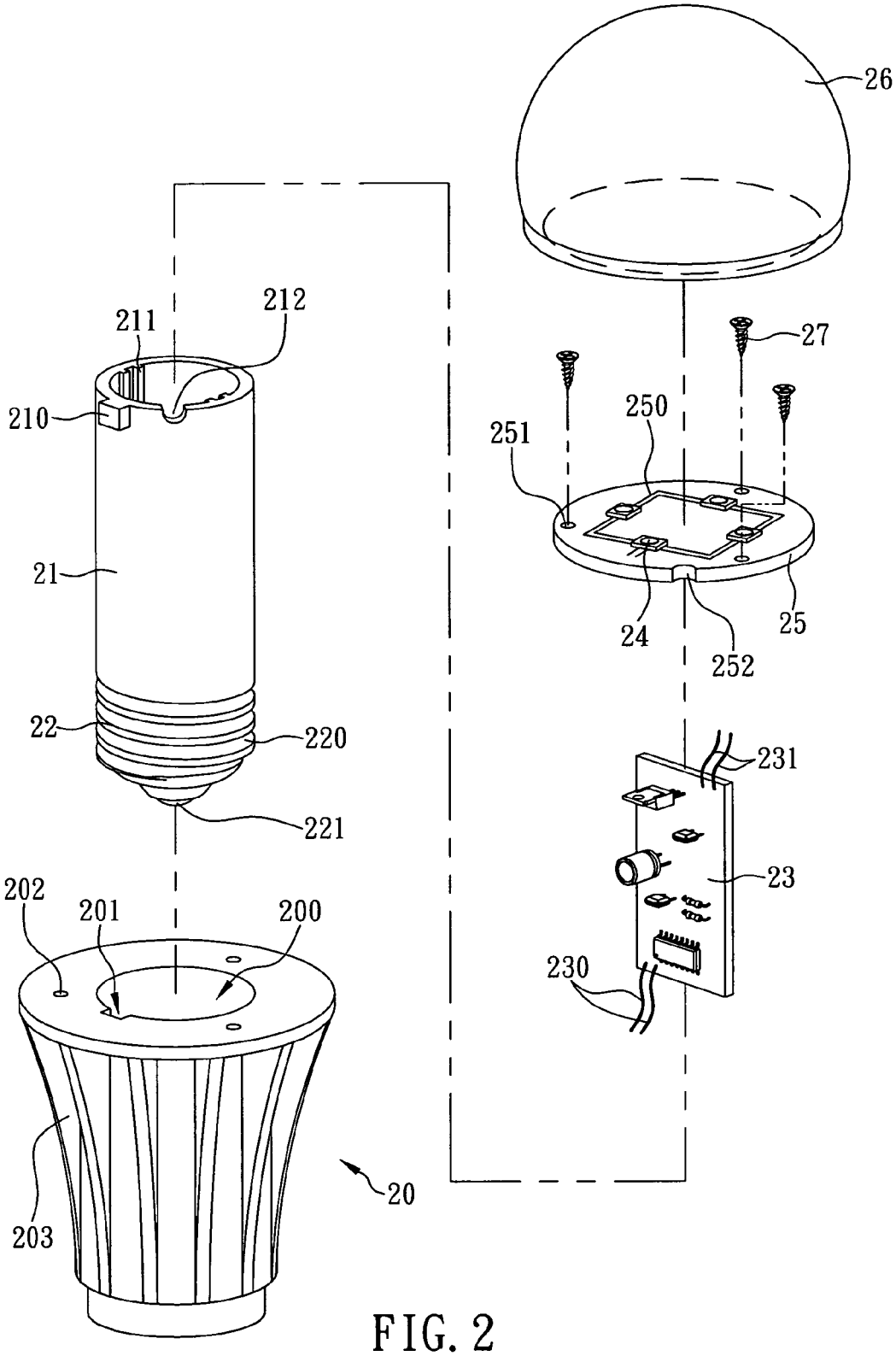
FIG. 2 is an exploded perspective view of an LED lamp according to a preferred embodiment of the present invention.

The present invention is related to an LED (light emitting diode) lamp. Referring now to FIG. 2, an LED lamp according to a preferred embodiment of the present invention is illustrated. As shown, the LED lamp comprises a heat dissipation housing 20, an insulation housing 21, an electrode cap 22, a power printed circuit board (PCB) 23, at least one LED 24, an installation base plate 25 and a lamp shade 26, wherein the heat dissipation housing 20 is a housing made of aluminum alloy or ceramic material. If the heat dissipation housing 20 is made of aluminum alloy, an outer periphery of the heat dissipation housing 20 is preferably extended outward to form a plurality of cooling fins 203, in order to increase the heat dissipation surface area of the heat dissipation housing 20 and enhance the heat dissipation efficiency of the heat dissipation housing 20. Alternatively, if the heat dissipation housing 20 is made of ceramic material, the structure design of the cooling fins 203 on the heat dissipation housing 20 can be omitted due to the relatively high thermal conductivity of the ceramic material toward air, in order to downsize the heat dissipation housing 20. The heat dissipation housing 20 is formed with a receiving hole 200 axially passed through the heat dissipation housing 20, and a position of an upper end of the heat dissipation housing 20 adjacent to the receiving hole 200 is formed with an engaged indentation 201. Furthermore, the insulation housing 21 can be made of synthetic resin or other insulation material. In the preferred embodiment, the shape of the insulation housing 21 is approximately cylindrical. However, in other embodiments of the present inventions, the shape of the insulation housing 21 is not limited thereto, wherein a manufacturer can change the shape of the receiving hole 200 and the insulation housing 21 to match with each other according to the actual need and the desired structural design for stably installing the insulation housing 21 into the receiving hole 200. Moreover, an upper end of an outer periphery of the insulation housing 21 is radially extended to form a projection 210 which can be inserted and engaged into the engaged indentation 201 in a case that the insulation housing 21 is installed in the receiving hole 200. Furthermore, each of two opposite positions of an inner periphery of the insulation housing 21 is formed with a positioning portion 211, respectively. In the preferred embodiment, each of the positioning portions 211 comprises two positioning ribs extended along an axial direction of the insulation housing 21, respectively. When the manufacturer fabricates the insulation housing 21, an injection molding method or other equivalent methods can be used to integrally form the insulation housing 21 and the positioning ribs (i.e. the positioning portions 211) therein.

Referring still to FIG. 2, in the preferred embodiment, the electrode cap 22 is a connector with a specification of E26 standard, but not limited thereto in other embodiments of the present invention, wherein the manufacturer can change to use a connector with other specification, such as E12, E14, E27 or E39 standard according to the actual need. The foregoing specification of E26 standard means that the diameter of the electrode cap 22 is 26 mm, while the specification of E12, E14, E27 or E39 standard means that the diameter of the electrode cap 22 is 12, 14, 27 or 39 mm. The electrode cap 22 comprises a first electrode 220 and a second electrode 221, wherein an opening edge of the electrode cap 22 is connected to a lower end of the insulation housing 21 to combine into one piece by screw-connection manner. Thus, in a case that the insulation housing 21 is installed in the receiving hole 200, the insulation housing 21 and the electrode cap 22 connected to the lower end thereof are simultaneously inserted the heat dissipation housing 20. Then, after the projection 210 is engaged with the engaged indentation 201, the electrode cap 22 is extended out of a lower end of the heat dissipation housing 20, so that the first and second electrodes 220, 221 of the LED lamp can be electrically connected to a lamp holder (not-shown) for receiving external power supplied through the lamp holder. In addition, the power PCB 23 is received in the insulation housing 21, wherein two opposite side edges of the power PCB 23 are clamped and positioned by the two positioning portions 211, respectively, so that the power PCB 23 can be stably positioned in the insulation housing 21. Besides, the power PCB 23 is electrically connected to the first and second electrodes 220, 221 through two first wires 230, respectively, for receiving the external power supplied through the first and second electrodes 220, 221. Furthermore, an upper end of the insulation housing 21 is formed with a first notch 212, while an edge of the installation base plate 25 is formed with a second notch 252. The shape of the installation base plate 25 is approximately a circular plane, wherein the installation base plate 25 has a first side (i.e. an upper side as shown in FIG. 2) provided with conductive circuits 250 for installing the LED 24. The power PCB 23 is further provided with two second wires 231 which can pass through the first and second notches 212, 252 and be electrically connected to the conductive circuits 250 of the installation base plate 25. Corresponding positions of an edge of the installation base plate 25 and the upper end of the heat dissipation housing 20 are formed with thread holes 251, 202, respectively. Thus, in a case that an edge of a second side (i.e. a lower side as shown in FIG. 2) of the installation base plate 25 is installed to be close to the upper end of the heat dissipation housing 20, the operator only needs to screw-connect the corresponding thread holes 251, 202 of the installation base plate 25 and the heat dissipation housing 20 by screws 27 for combining the installation base plate 25 with the heat dissipation housing 20 into one piece. Therefore, the insulation housing 21 can be stably mounted in the heat dissipation housing 20, while the electrode cap 22 on the lower end of the insulation housing 21 can be extended out of the lower end of the heat dissipation housing 20 a predetermined length for electrically connecting to the lamp holder. However, in other embodiments of the present invention, the connection between the installation base plate 25 and the heat dissipation housing 20 is not limited thereto, wherein the manufacturer can use an adhesive to attach the edge of the second side of the installation base plate 25 to the upper end of the heat dissipation housing 20 according to the actual installation need, in order to carry out similar rapid installation effect of the present invention. Besides, the lamp shade 26 is covered on the first side (i.e. the upper side as shown in FIG. 2) of the installation base plate 25, and an opening edge of the lamp shade 26 is connected to an edge of the upper end of the heat dissipation housing 20 by means of adhesive, screw-connection or engagement, so as to combine into one piece.

Figure 3:
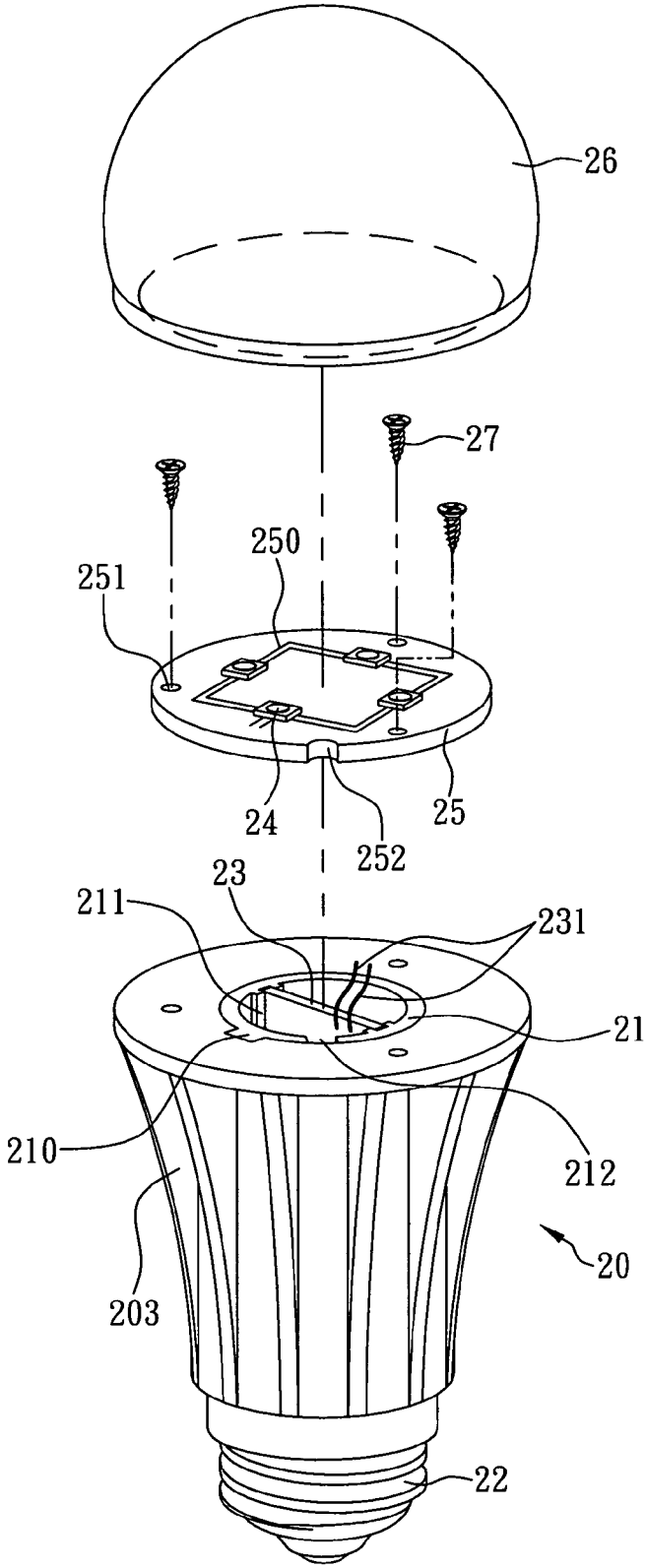
FIG. 3 is another exploded perspective view of the LED lamp according to the preferred embodiment of the present invention after some components are installed.

Referring now to FIGS. 2 and 3, in the foregoing preferred embodiment, when the manufacturer installs the LED lamp of the present invention, the operator only needs to firstly insert the insulation housing 21 with the electrode cap 22 connected to the lower end thereof into the receiving hole 200 for allowing the projection 210 to be engaged with the engaged indentation 201 and allowing the electrode cap 22 to be extended out of the lower end of the heat dissipation housing 20, secondly insert the power PCB 23 into the insulation housing 21 along the positioning portions 211 for electrically connecting the power PCB 23 to the first and second electrodes 220, 221 through the two first wires 230, respectively, and electrically connecting the power PCB 23 to the installation base plate 25 through the two second wires 231, thirdly position the installation base plate 25 on the upper end of the heat dissipation housing 20, and finally cover the lamp shade 26 on the upper end of the heat dissipation housing 20 to rapidly and precisely complete the installation procedures of the foregoing components and speedily finish the LED lamp. Therefore, it is unnecessary for the operator of the manufacturer to manually screw-connect components to the heat dissipation housing 20 in turn by screws, as described in the installation of the traditional LED lamp. As a result, it not only can efficiently save the manpower source, but also can further save the operational time of the production line, so as to enhance the unit per hour (UPH) of the LED lamp. In addition, the operator can install the insulation housing 21 and the electrode cap 22 to the heat dissipation housing 20 to precisely install these components with each other without aligning the positions of the insulation housing 21 and the heat dissipation housing 20 by naked eyes, as described in the installation of the traditional LED lamp. Thus, the error installation of the operator and the imprecise positioning problem of all components can be efficiently prevented, so as to substantially enhance the product yield of the LED lamp. Moreover, the present invention can ensure the positioning precision between the insulation housing 21, the electrode cap 22 and the heat dissipation housing 20, so that the position offset of installing the power PCB 23 in the insulation housing 21 can be avoided. Meanwhile, the short-circuit risk of accidentally contacting circuits of the power PCB 23 with the heat dissipation housing 20 or the installation base plate 25 also can be prevented.

The present invention has been described with a preferred embodiment thereof and it is understood that many changes and modifications to the described embodiment can be carried out without departing from the scope and the spirit of the invention that is intended to be limited only by the appended claims.

What is claimed is:

1. An LED lamp, comprising:

a heat dissipation housing formed with a receiving hole axially passed therethrough, and a position of an upper end of the heat dissipation housing adjacent to the receiving hole being formed with an engaged indentation;

an insulation housing made of insulation material, and the profile of the insulation housing capable of being installed into the receiving hole, an upper end of an outer periphery of the insulation housing radially extended to form a projection which is configured to be inserted and engaged into the engaged indentation in a case that the insulation housing is installed in the receiving hole;

an electrode cap comprising a first electrode and a second electrode, wherein an edge of the electrode cap is connected to a lower end of the insulation housing, and wherein the electrode cap is extended out of a lower end of the heat dissipation housing in a case that the insulation housing is installed in the receiving hole and the projection is engaged with the engaged indentation;

a power printed circuit board (PCB) received in the insulation housing, and electrically connected to the first and second electrodes, respectively;

at least one LED, and an installation base plate having a first side provided with conductive circuits for installing the LED and being electrically connected to the power PCB, and a second side connected to the upper end of the heat dissipation housing.

2. The LED lamp according to claim 1, further comprising a lamp shade which is covered on the first side of the installation base plate, and an opening edge of the lamp shade is connected to an edge of the upper end of the heat dissipation housing.

3. The LED lamp according to claim 2, wherein each of two opposite positions of an inner periphery of the insulation housing is formed with a positioning portion, respectively, and two opposite side edges of the power PCB are clamped by the two positioning portions, respectively, so that the power PCB is stably positioned in the insulation housing.

4. The LED lamp according to claim 3, wherein each of the positioning portions comprises two positioning ribs extended along an axial direction of the insulation housing, respectively.

5. The LED lamp according to claim 4, wherein an outer periphery of the heat dissipation housing is extended outward to form a plurality of cooling fins.

6. The LED lamp according to claim 5, wherein corresponding positions of an edge of the installation base plate and the upper end of the heat dissipation housing are formed with thread holes, respectively, and a plurality of screws are used to screw-connect the corresponding thread holes of the installation base plate and the heat dissipation housing for combining the installation base plate with the heat dissipation housing into one piece in a case that an edge of the second side of the installation base plate is installed to be close to the upper end of the heat dissipation housing.

7. The LED lamp according to claim 5, wherein an adhesive is used to attach an edge of the second side of the installation base plate to the upper end of the heat dissipation housing.

* * * * *